US007240998B2

(12) United States Patent
Murakami et al.

(10) Patent No.: US 7,240,998 B2
(45) Date of Patent: Jul. 10, 2007

(54) LIQUID JETTING DEVICE AND LIQUID JETTING METHOD

(75) Inventors: Takaaki Murakami, Kanagawa (JP); Yuji Yakura, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 11/466,125

(22) Filed: Aug. 22, 2006

(65) Prior Publication Data

US 2006/0284941 A1 Dec. 21, 2006

Related U.S. Application Data

(63) Continuation of application No. 10/877,392, filed on Jun. 25, 2004, now Pat. No. 7,168,774.

(30) Foreign Application Priority Data

Jun. 27, 2003 (JP) ..... P2003-184025

(51) Int. Cl.
*B41J 2/12* (2006.01)
*B41J 2/09* (2006.01)

(52) U.S. Cl. ..... 347/78; 347/77

(58) Field of Classification Search ..... 347/5, 347/8–9, 19, 77, 78
See application file for complete search history.

(56) References Cited

U.S. PATENT DOCUMENTS 6,550,886 B2 * 4/2003 Shimizu et al. ..... 347/19
6,817,704 B2 * 11/2004 Eguchi et al. ..... 347/60

* cited by examiner

*Primary Examiner*—Matthew Luu
*Assistant Examiner*—Lisa M. Solomon
(74) *Attorney, Agent, or Firm*—Sonnenschein Nath & Rosenthal LLP

(57) ABSTRACT

Disclosed is a liquid jetting device which includes: a liquid chamber for containing a liquid to be jetted out; an energy generation element for imparting energy to the liquid in the liquid chamber; and a nozzle for jetting out the liquid in the liquid chamber as a droplet by the energy generation element. In the liquid jetting device, a plurality of the nozzles are arrayed to constitute a head, and a plurality of the heads are arrayed in a direction orthogonal to the array direction of the nozzles to constitute a head array. In addition, the droplet jetted out from each of the nozzle in the head array is deposited on a recording medium to form a dot. Further, the jetting direction of the droplet jetted out from the nozzle can be deflected by controlling the manner in which the energy is imparted to the liquid by the energy generation element. Furthermore, an error in the deposition position of the dot due to an error in the position of the head in the head array is corrected.

3 Claims, 11 Drawing Sheets

LIQUID JETTING DEVICE AND LIQUID JETTING METHOD

RELATED APPLICATION DATA

This application is a continuation of U.S. patent application Ser. No. 10/877,392, filed Jun. 25, 2004 now U.S. Pat. No. 7,168,774, which is incorporated herein by reference to the extent permitted by law. This application claims the benefit of priority to Japanese Patent Application No. JP2003-184025, filed Jun. 27, 2003, which also is incorporated herein by reference to the extent permitted by law.

BACKGROUND OF THE INVENTION

The present invention relates to a technology for improving image quality by correcting errors in the deposition positions of droplets in a liquid jetting device and a liquid jetting method for depositing the droplets on a recording medium to form dots.

Further, the present invention relates to a technology for enhancing the image quality concerning the resolution of record dots by intentionally shifting the deposition positions of the droplets.

Conventionally, an ink jet printer, which is one of liquid jetting devices, generally includes a head in which nozzles are arranged rectilinearly. Minute ink droplets are jetted out from each of the nozzles of the head toward a recording medium, such as a printing paper, disposed opposite to the nozzle surface, to form roughly circular dots in column direction and row direction, thereby expressing images and characters as dot pictures.

Here, as one of ink jetting systems, there has been known the thermal system for jetting out an ink or inks by use of thermal energy.

The jetting device of the thermal system includes ink chambers for containing an ink as a liquid, heat-generating resistors as energy generation elements provided in the ink chambers, and nozzles for jetting out the ink as droplets. The ink is rapidly heated by the heat generation element, to generate a bubble in the ink on the heat generation element, and an ink droplet is jetted out from the nozzle by the energy at the time of bubble generation.

From the viewpoint of head structure, further, the ink jetting devices are classified into the serial system for printing while moving the head in the width direction of the recording medium, and the line system in which a multiplicity of heads are arrayed in the width direction of the recording medium to constitute a line head corresponding to the width of printing.

In the line system, a technological approach in which the head extending over the entire width of the recording medium is integrally formed by use of a silicon wafer, a glass or the like is impractical, due to the presence of various problems as to manufacturing method, yield, heat generation, cost, etc.

Therefore, as disclosed in Japanese Patent Laid-Open No. 2002-36522 or the like, there has been known a technology in which a plurality of small heads (they also involve various limitations, and a practical limit of the length in the array direction of nozzles is no more than about 1 inch) are aligned so that their ends become continuous with each other, and an appropriate signal processing is applied to the individual heads, thereby recording images continuous with each other over the entire width of the recording medium at the stage of printing on the recording medium.

However, the above-mentioned related art involves the following problems.

First, an ideal condition will be described. FIGS. 8A and 8B schematically illustrate a head array formed by arraying heads in a direction orthogonal to the array direction of nozzles, and the dots formed by droplets jetted out from the nozzles of the heads.

Specifically, FIG. 8A shows that four heads 11A, 11B, 11C and 11D each constructed by arraying nozzles 18 in a row are arrayed in the direction orthogonal to the array direction of the nozzles 18 to constitute a head array including the four heads. Four color inks, i.e., yellow, cyan, magenta, and black inks are individually contained as liquids in ink chambers (not shown), and energy generation elements (not shown) for imparting energy to the liquids in the ink chambers are provided, whereby the four different-colored inks are jetted out as droplets from the nozzles 18 on the basis of each of the heads 11A to 11D.

Here, for convenience, X direction and Y direction are defined as shown in FIG. 8A (hereinafter, this applies also to other figures).

Therefore, in the case of the line system, the heads 11A to 11D are arrayed in respective lengths comparable to the width (in the X direction) of the recording medium, and, without moving the head array composed of the heads 11A to 11D arrayed in the Y direction, the recording medium is fed in the Y direction, whereby printing can be conducted over the whole surface area of the recording medium.

In addition, while the heads arrayed in the Y direction can respectively jet out the four different-colored inks to print color images in this case, more than four colors are used in some other cases.

Incidentally, the nozzles 18 are schematically treated as to number and size, for easier understanding of the illustration.

Besides, in some cases, the inks are jetted from the nozzles not at the same timing but at appropriately staggered timings at the time of printing. In such a case, for preventing errors from being generated in the deposition positions on the recording medium, the positions of the nozzles in the Y direction may be preliminarily corrected according to the jetting timing sequence. For easier understanding of the illustration, here, an example in which the nozzle positions in the Y direction are all on straight lines is illustrated as a representative example.

Incidentally, in the case of the serial system, the head array composed of the heads 11A to 11D performs printing in the width direction (the Y direction) of the recording medium while being moved in the Y direction in FIG. 8A. Then, when the head array has been moved by a one-pass distance, the recording medium is moved by a predetermined amount in the X direction, and the head array repeats the same operation, thereby printing over the whole surface area of the recording medium.

Next, FIG. 8B illustrates the dots D formed by the ideal head array shown in FIG. 8A.

Whether the head array may be of the line system or the serial system, if there is no deflection in the jetting directions at the time of jetting out the ink droplets from the nozzles 18 of the heads, the deposition positions of the droplets correspond to the nozzles 18, so that the dots D aligned in the X direction on the recording medium are also formed in correspondence with the nozzles 18.

Where there is no deflection in the jetting directions, the forming positions of the dots D in the Y direction are determined by the feeding velocity of the recording medium and the jetting timings of the droplets from the nozzles 18 in the line system. In the serial system, the forming positions of the dots D in the Y direction are determined by the moving velocity of the head array and the jetting timings of the droplets from the nozzles 18.

For easier understanding of illustration, here, the dots are schematically treated as to position and size so that they touch each other both in the X direction and in the Y direction.

In response to printing data, the ink droplets are jetted on an on-demand basis independently for each color, and the dots D deposited on the recording medium such as a printing paper are superposed on each other, whereby color printing can be achieved.

In some cases, color printing can be realized by changing not only the color of droplets but also the concentration of droplets, the number of droplets jetted, the amount jetted, the deposition positions of droplets, the deposition area of droplets, or the like. For simplification of description, however, it is assumed here that the dots D formed by the droplets in four colors are equal in size and the number of the droplets jetted from one nozzle in one operation is one.

Then, in the ideal head array shown in FIG. 8A, the dots D formed by the droplets jetted out from the corresponding nozzles 18 (the n-th nozzles as viewed in the X direction) of the heads 11A to 11D are exactly superposed on each other if their positions in the Y direction coincide with each other, as shown in FIG. 8B.

In other words, it is ideal to configure the head array so that the dots D as shown in FIG. 8B will be formed.

In practice, however, it is difficult to constitute the ideal head array as shown in FIG. 8A, due to the problems concerning scattering on a production basis, yield, cost, and the like.

For example, in the head array shown in FIG. 9A, only the head 11C among the heads 11A to 11D has a positional error in the X direction. Due to the positional error, the dots $D_C$ formed by the droplets jetted out from the nozzles of the head 11C show positional errors in the X direction as shown in FIG. 9B.

With the head array including such a mispositioned head, intrinsic printing conforming to given printing data cannot be achieved, so that a lowered print quality results.

In addition, as a means for coping with an increase in resolution of record dots desired, it has been practiced to enhance the density of the nozzles arrayed in the heads. However, there is a limitation to the narrowing of the nozzle pitch.

In view of this, in some cases, as shown in FIG. 10A, a plurality of heads (two heads 11A and 11B, in the case of FIG. 10) equal in the pitch of nozzles 18 are aligned, with their pitches staggered from each other (by half pitch, in the case of FIG. 10), i.e., the heads are arranged in a staggered manner, to enhance (in the case of FIG. 10, to double) the resolution.

If the head array is an ideal head array as shown in FIG. 10A, the dots $D_A$ and $D_B$ formed by the droplets jetted out from the nozzles 18 of the heads 11A and 11B are staggered from each other by half pitch when their positions in the Y direction coincide, as shown in FIG. 10B. In practice, however, it is difficult to realize such an ideal head array, due to the scattering on a production basis and the like.

Accordingly, as represented by the head array shown in FIG. 11A, the nozzle pitches would be staggered halfway and, as a result, the dots $D_A$ formed by the droplets jetted out from the nozzles of the head 11A and the dots $D_B$ relevant to the head 11B would overlap with each other, as shown in FIG. 11B.

With such a head array, intrinsic printing conforming to given printing data cannot be achieved, so that a lowered print quality results.

SUMMARY OF THE INVENTION

Accordingly, it is an object of the present invention to ensure that intrinsically intended printing can be achieved by use of the technology for enabling deflection of the jetting directions of droplets already proposed by the present applicant (see, for example, Japanese Patent Application Nos. 2002-161928, 2002-320861, and 2002-320862), and to prevent printing quality from being lowered.

According to an aspect of the present invention, there is provided a liquid jetting device including:

a liquid chamber for containing a liquid to be jetted out;

an energy generation element for imparting energy to the liquid in the liquid chamber; and a nozzle for jetting out the liquid in the liquid chamber as a droplet by the energy generation element;

a plurality of the nozzles being arrayed to constitute a head, and a plurality of the heads being arrayed in a direction orthogonal to the array direction of the nozzles to constitute a head array; and the droplet jetted out from each of the nozzle in the head array being deposited on a recording medium to form a dot, wherein the jetting direction of the droplet jetted out from the nozzle can be deflected by controlling the manner in which the energy is imparted to the liquid by the energy generation element, and an error in the deposition position of the dot due to an error in the position of the head in the head array is corrected.

According to another aspect of the present invention, there is provided a liquid jetting method including the steps of:

imparting energy to a liquid in a liquid chamber by an energy generation element, jetting out the liquid in the liquid chamber as droplets from nozzles arrayed in a head, and depositing the droplets jetted out from the nozzles on a recording medium to form dots, wherein the jetting direction of the droplet jetted out from the nozzle can be deflected by controlling the manner in which the energy is imparted to the liquid by the energy generation element, and an error in the deposition position of the dot due to an error in the position of the head in a head array formed by arraying the heads in a direction orthogonal to the array direction of the nozzles is corrected.

In the invention as above, each nozzle of the head is so formed that a droplet can be jetted out therefrom in a plurality of different directions. In addition, a plurality of the heads each formed by arraying the nozzles are arrayed in a direction orthogonal to the array direction of the nozzles to constitute a head array.

Further, errors in the deposition positions of the dots are corrected so that the dot formed by the droplet jetted out from the n-th nozzle of one head in the head array and the dot formed by the droplet jetted out from the n-th nozzle of another head in the head array are superposed on each other or are not superposed on each other. Besides, where the nozzles are arrayed at a pitch P and S pieces of the heads are arrayed, the errors in the deposition positions of the dots are corrected so that the centers of the two kinds of dots are staggered from each other by P/S.

To be more specific, for example in the case of color printing, the deposition positions of droplets are so regulated that the dots formed by the droplets jetted out from the corresponding nozzles of the different heads are superposed on each other. On the other hand, in the case of contriving a higher resolution, the deposition positions of droplets are so regulated that the dots formed by the droplets jetted out from the corresponding nozzles of the different heads are not superposed on each other.

In addition, in the case of contriving a higher resolution, the deposition positions of droplets can be so corrected that the dots relevant to one head are respectively formed between the dots relevant to another head.

The above and other objects, features and advantages of the present invention will become apparent from the following description and the appended claims, taken in conjunction with the accompanying drawings in which like parts or elements denoted by like reference symbols.

DETAILED DESCRIPTION OF THE PREFERRED EMBODIMENT

Figure 1:
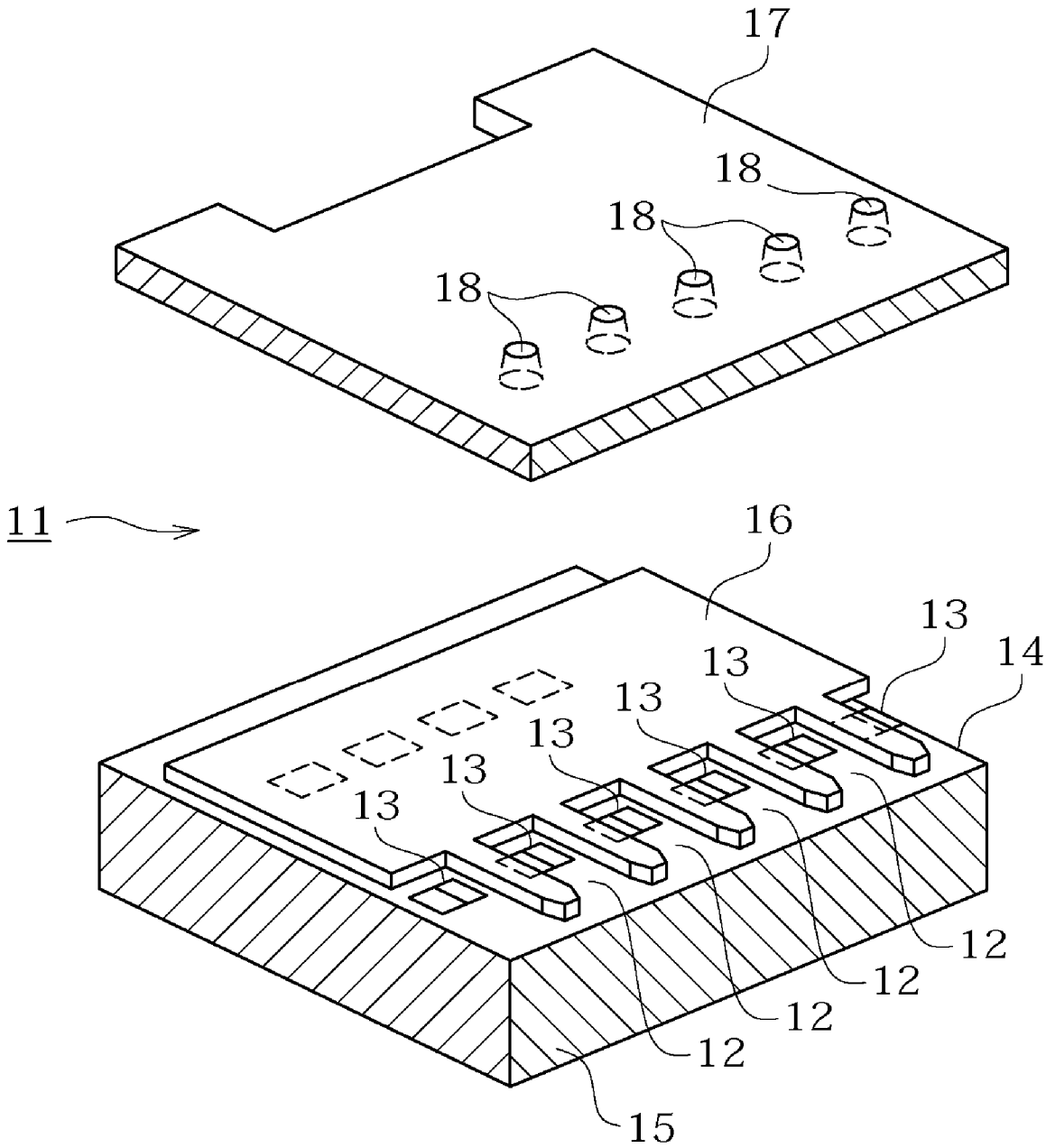
FIG. 1 is an exploded perspective view of a head of an ink jet printer to which the liquid jetting device according to the present invention has been applied.

Now, one embodiment of the present invention will be described below referring to the drawings and the like.

The liquid jetting device in the following embodiment is an ink jet printer, in which an ink is used as a liquid, a liquid chamber for containing the ink is an ink chamber, a minute amount (for example, a few picoliters) of the ink jetted out from a nozzle is a droplet, and a dot means what is formed by deposition of one droplet on a recording medium such as a printing paper.

In addition, energy is imparted to the ink in the ink chamber by an energy generation element (in this embodiment, a heat-generating resistor 13), and the ink is jetted out as the droplet. Besides, the manner in which the energy is imparted to the ink by the energy generation element is controlled, whereby the jetting direction of the droplet jetted out from the nozzle can be deflected. Incidentally, the energy generation element may constitute one surface of the ink chamber.

Here, in the case where different-colored inks are used, deposition of one droplet forms a dot in the color of the droplet, and deposition of a plurality of droplets at the same position forms a dot in a color formed according to the colors of the droplets. Therefore, by formation of a multiplicity of dots on the recording medium, color printing is realized. Besides, by such a control that a multiplicity of droplets are not deposited at the same position in the region for printing, high-resolution printing is realized. It should be noted here that there may naturally be a region or regions on the recording medium in which no droplet is deposited.

Incidentally, the liquid jetting device used in the present invention is naturally not limited to the following embodiment.

FIG. 1 is an exploded perspective view of a head 11 of an ink jet printer (hereinafter referred to simply as "printer") to which the liquid jetting device according to the present invention has been applied. In FIG. 1, a nozzle sheet 17, which is adhered onto a barrier layer 16, is illustrated in an exploded state.

In the head 11, a substrate member 14 includes a semiconductor substrate 15 formed of silicon or the like, and heat-generating resistors 13 formed by crystallization on one side of the semiconductor substrate 15. The heat-generating resistors 13 are electrically connected to an external circuit through conductor portions (not shown) formed on the semiconductor substrate 15.

In addition, the barrier layer 16 is composed, for example, of a photosensitive cyclized rubber resist or an exposure-curable type dry film resist, and is formed by laminating the resist on the entire part of the side of the semiconductor substrate 15 on which the heat-generating resistors 13 are formed and then removing unrequired portions thereof by photolithographic process.

Furthermore, the nozzle sheet 17 is provided with a plurality of nozzles 18, and is formed by electrodeposition of nickel, for example. The nozzle sheet 17 is adhered onto the barrier layer 16 so that the positions of the nozzles 18 conform to the positions of the heat-generating resistors 13, i.e., so that the nozzles 18 are opposed to the heat-generating resistors 13.

Ink chambers 12 are composed of the substrate member 14, the barrier layer 16 and the nozzle sheet 17 so that they each surround the heat-generating resistor 13. Specifically, in FIG. 1, the substrate member 14 constitutes the bottom walls of the ink chambers 12, the barrier layer 16 constitute the side walls of the ink chambers 12, and the nozzle sheet 17 constitutes the ceiling walls of the ink chambers 12. As a result, the ink chambers 12 have opening regions on the right front side in FIG. 1, and the opening regions are communicated with an ink conduits (not shown).

One head 11 generally includes about 100 ink chambers 12 and about 100 heat-generating resistors 13 disposed respectively in the ink chambers 12. By commands from a control unit of the printer, the individual ones of the heat-generating resistors 13 can be uniquely selected, and the ink in the ink chambers 12 corresponding to the selected heat-generating resistors 13 can be jetted out from the nozzles 18 opposed to the ink chambers 12.

Specifically, the ink chambers 12 are filled with an ink supplied from an ink tank (not shown) coupled to the head 11. Then, a pulse current is passed to the heat-generating resistor 13 for a short time, for example, 1 to 3 μsec, whereby the heat-generating resistor 13 is rapidly heated. As a result, an ink bubble in vapor phase is generated at an ink portion in contact with the heat-generating resistor 13, and expansion of the ink bubble pushes away a volume of the ink (the ink boils). This results in that the ink being at an ink portion in contact with the nozzle 18 and having a volume equivalent to the volume of the pushed-away ink is jetted out as a droplet through the nozzle 18, to be deposited on a printing paper used as the recording medium, whereby a dot is formed.

In this embodiment, further, a plurality of heads 11 are arrayed in the width direction of the recording medium to constitute a line head.

Figure 2:
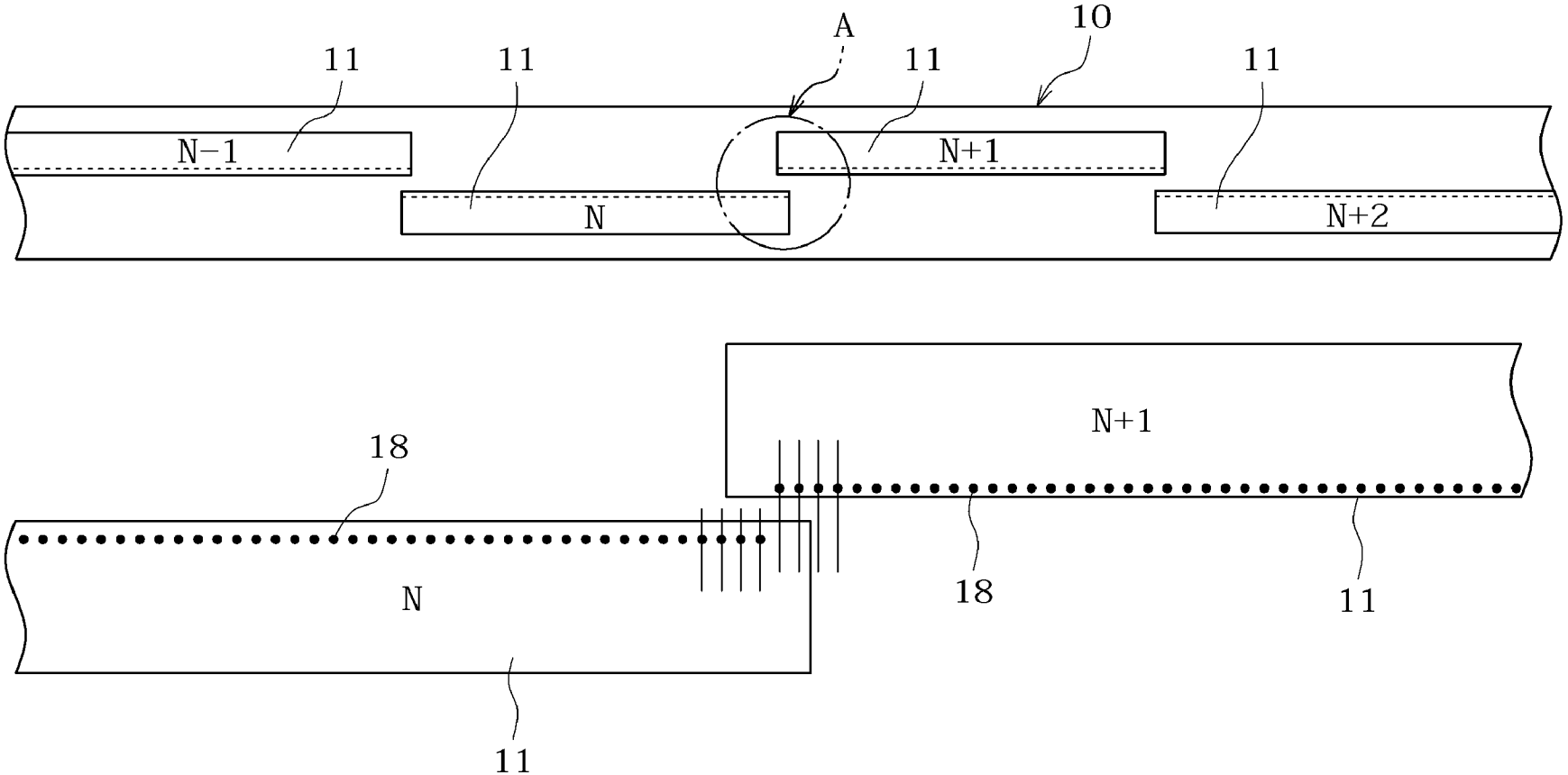
FIG. 2 is a plan view showing one embodiment of a line head.

FIG. 2 is a plan view illustrating one embodiment of the line head 10. In FIG. 2, four heads 11 ("N−1", "N", "N+1", and "N+2") are shown. In constructing the line head 10, a plurality of the portions (head chips) each obtained by removing the nozzle sheet 17 from the head 11 of FIG. 1 are arrayed. Then, a single nozzle sheet 17 provided with the nozzles 18 at positions corresponding to the individual ink chambers 12 of all the head chips is adhered to the upper portions of these head chips, to form the line head 10.

Here, the individual heads 11 are so disposed that the pitch between the nozzles located at the facing ends of the adjacent heads 11, specifically, in the detailed view of portion A in FIG. 2, the spacing between the nozzle 18 located at the right end portion of the N-th head 11 and the nozzle 18 located at the left end portion of the (N+1)th head 11 is equal to the interval of the nozzles 18 in the heads 11.

In addition, a required number of such line heads 10 are arrayed in a direction orthogonal to the array direction of the nozzles 18 to constitute a head array. It should be noted here that, in place of combining the separate line heads 10 together, an integral structure may be adopted in which a plurality of heads each composed of an array of nozzles are arranged in advance in the direction orthogonal to the array direction of the nozzles.

As for the positional relationship between the adjacent heads in the head array, the positions of the corresponding nozzles conform to each other in the case of color printing or the like, and are set off from each other in the case of high-resolution printing or the like.

Now, the nozzle portion in this embodiment will be described more in detail.

Figure 3A:
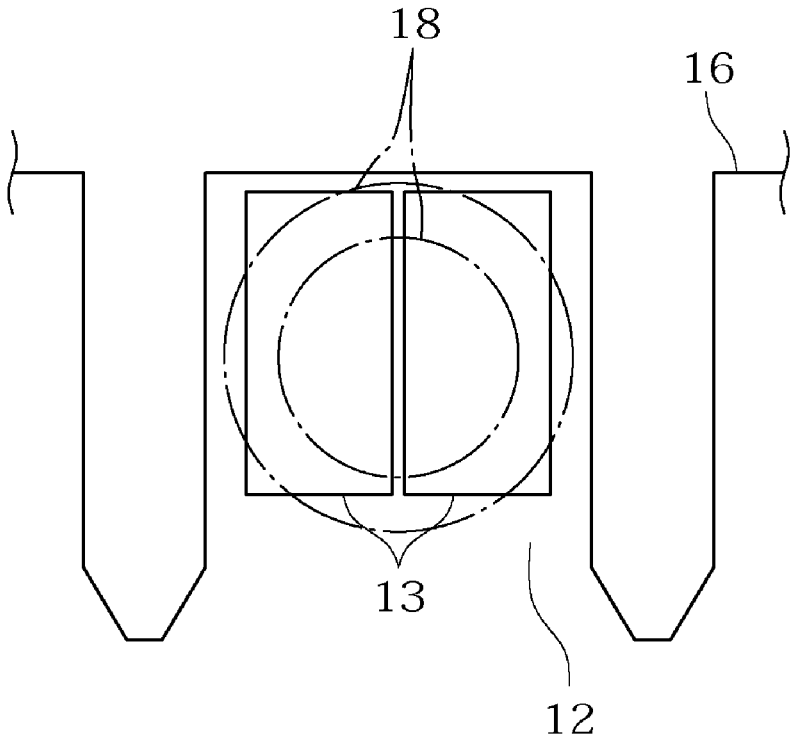
FIGS. 3A and 3B respectively show a plan view and a sectional view of a side surface, showing in more detail the nozzle of the head shown in FIG. 1.
Figure 3B:
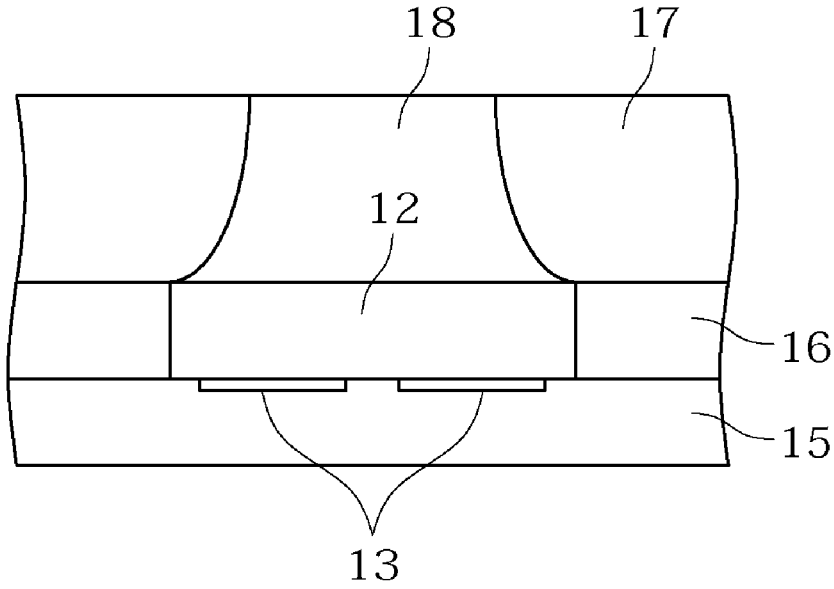

FIGS. 3A and 3B respectively show a plan view and a sectional view of a side surface, illustrating specifically one nozzle portion of the head 11.

As shown in FIG. 3, in the head 11 in this embodiment, two split heat-generating resistors 13 are aligned in one ink chamber 12. Further, the alignment direction of the split two heat-generating resistors 13 is the same with the array direction of the nozzles 18 (the left-right direction in FIG. 3). Incidentally, the nozzle 18 is indicated by dot-dash lines in the plan view in FIG. 3.

Where the two split heat-generating resistors 13 are thus provided in one ink chamber 12, when the periods of time taken for the individual heat-generating resistors 13 to reach the temperature for boiling the ink (bubble generation times) are equal, the ink boil simultaneously on the two heat-generating resistors 13, so that the ink droplet is jetted out in the direction of the center line of the nozzle 18.

On the other hand, where a time difference is provided between the bubble generation times of the two split heat-generating resistors 13, the ink would not boil simultaneously on the two heat-generating resistors 13. As a result, the jetting direction of the droplet is deflected (deviated) from the direction of the center line of the nozzle 18. Therefore, the droplet can be deposited at a position deviated from the deposition position reached when the droplet is jetted out without deflection.

Figure 4:
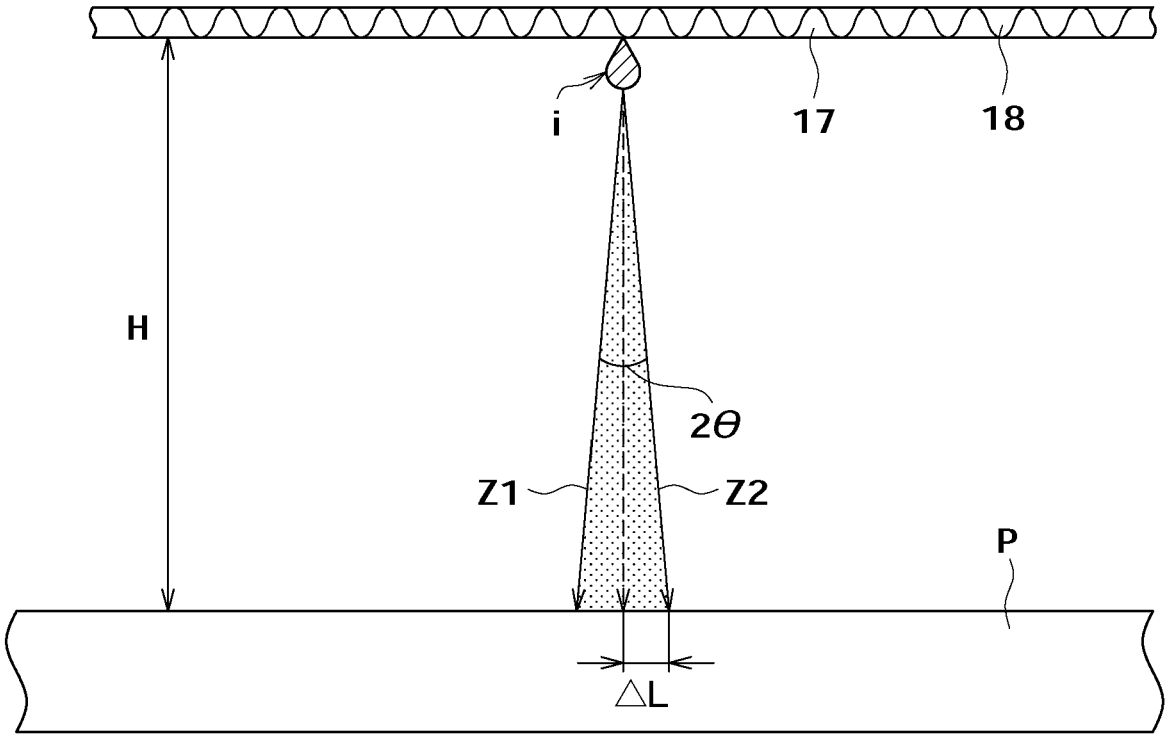
FIG. 4 is an illustration of deflection of the jetting direction of ink.

FIG. 4 illustrates the deflection of the jetting direction of the droplet. In FIG. 4, when the ink droplet i is jetted out perpendicularly to the ink droplet jetting surface, the ink droplet i is jetted without deflection, as indicated by broken-line arrow in FIG. 4. On the other hand, when the ink droplet jetting direction is deflected and the jetting angle is deviated by θ from the perpendicular position (the ink droplet is jetted out in the direction Z1 or Z2 in FIG. 4), the deposition position of the ink droplet is deviated by ΔL, which is obtained by the formula:

$$\Delta L = H \times \tan\theta$$

where H (roughly constant) is the distance between the jetting-out surface and the surface (the deposition surface for the ink droplet) of the printing paper P used as the recording medium.

Figure 5A:
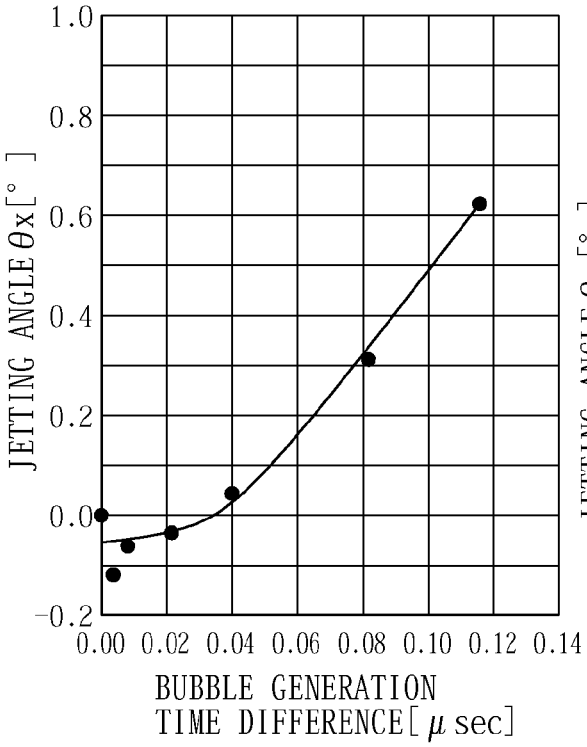
FIGS. 5A and 5B show simulation results for illustrating the relationship between the bubble generation time difference generated for an ink by split heat-generating resistors and the jetting angle of the ink.
Figure 5B:
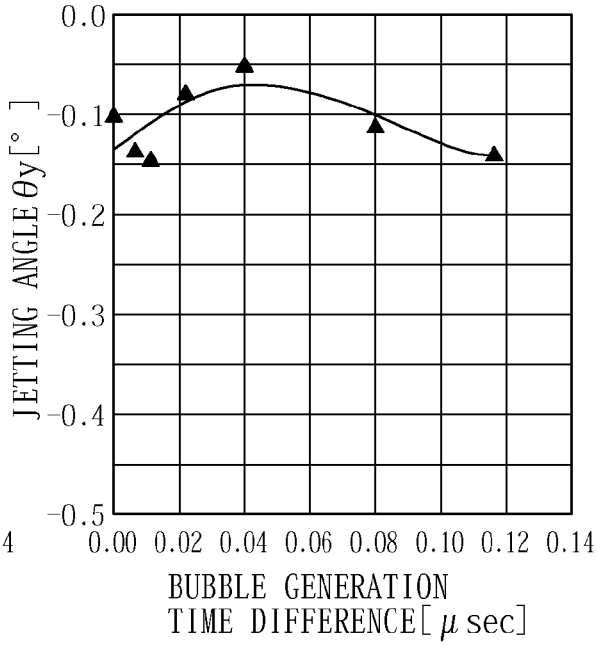

FIGS. 5A and 5B show graphs showing the relationship between the ink bubble generation time difference between the two split heat-generating resistors 13 and the jetting angle of the ink, and show the results of simulations conducted by use of a computer.

Figure 8A:
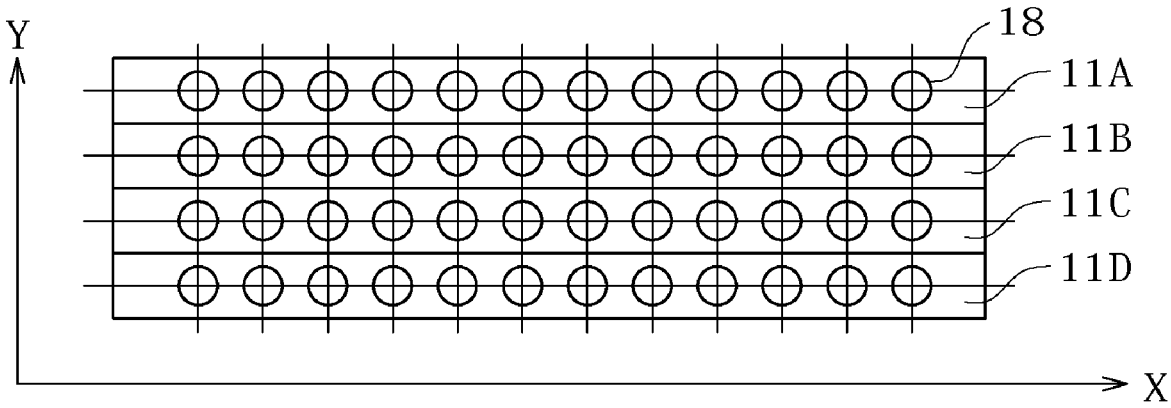
FIGS. 8A and 8B schematically illustrate nozzles in an ideal head array and the dots formed by use of the same.

In the graphs, the X direction (the direction indicated by the axis of ordinates θx in the graph, not meaning the axis of abscissas of the graph) is the array direction of the nozzles (the alignment direction of the heat-generating resistors 13), as in FIG. 8, and the Y direction (the direction indicated by the axis of ordinates θy, not meaning the axis of ordinates of the graph) is the direction (the feeding direction of the recording medium) perpendicular to the X direction, as in FIG. 8.

Figure 5C:
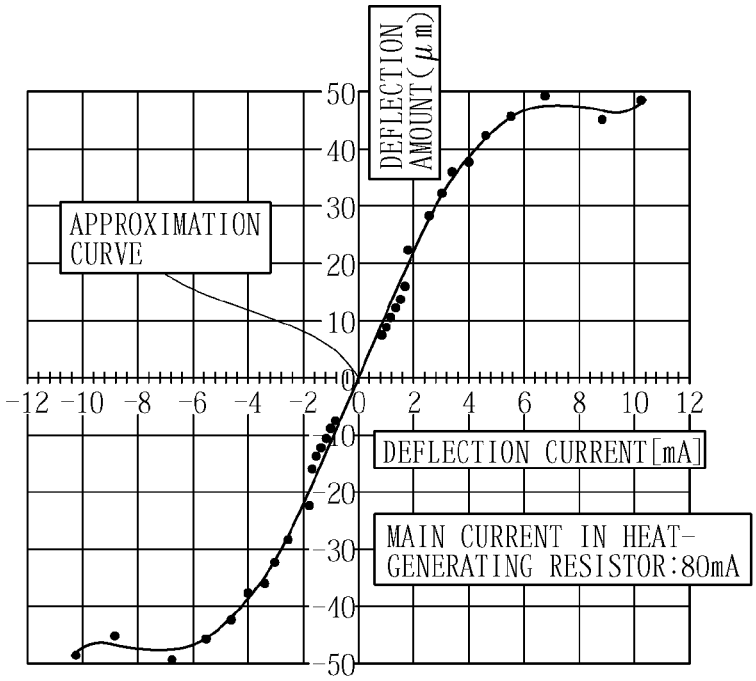
FIG. 5C shows actual measurement data illustrating the relationship between the current difference (deflection current) between the split heat-generating resistors and the deflection amount.

In addition, FIG. 5C shows actual measurement data, in which deflection current equal to one half of the current difference between the two split heat-generating resistors 13 is taken on the axis of abscissas, as the ink bubble generation time difference between the two split heat-generating resistors 13, and the deviation amount (actually measured with the above-mentioned H being about 2 mm) at the deposition position of the ink is taken on the axis of ordinates, as the ink jetting angle (X direction).

In FIG. 5C, a main current for the heat-generating resistors 13 was set at 80 mA, the above-mentioned deflection current was superposed on the current supplied to one of the heat-generating resistors 13, and the ink was thereby jetted out with deflection.

Where a time difference is present between the bubble generations at the heat-generating resistors 13 bisected in the array direction of the nozzles, the ink jetting angle is not perpendicular, and the ink jetting angle θx (the deviation amount from the vertical line, corresponding to θ in FIG. 4) in the array direction of the nozzles 18 increases with the bubble generation time difference, as shown in FIG. 5A.

Thus, when the two split heat-generating resistors 13 are provided and the currents passed to the heat-generating resistors 13 are set to be different, it is possible to perform such a control as to generate a time difference between the bubble generation times on the two heat-generating resistors 13. Then, it is possible to deflect the ink jetting direction, according to the time difference.

Next, the method of deflecting the jetting direction of the ink droplet will be described more in detail.

Figure 6:
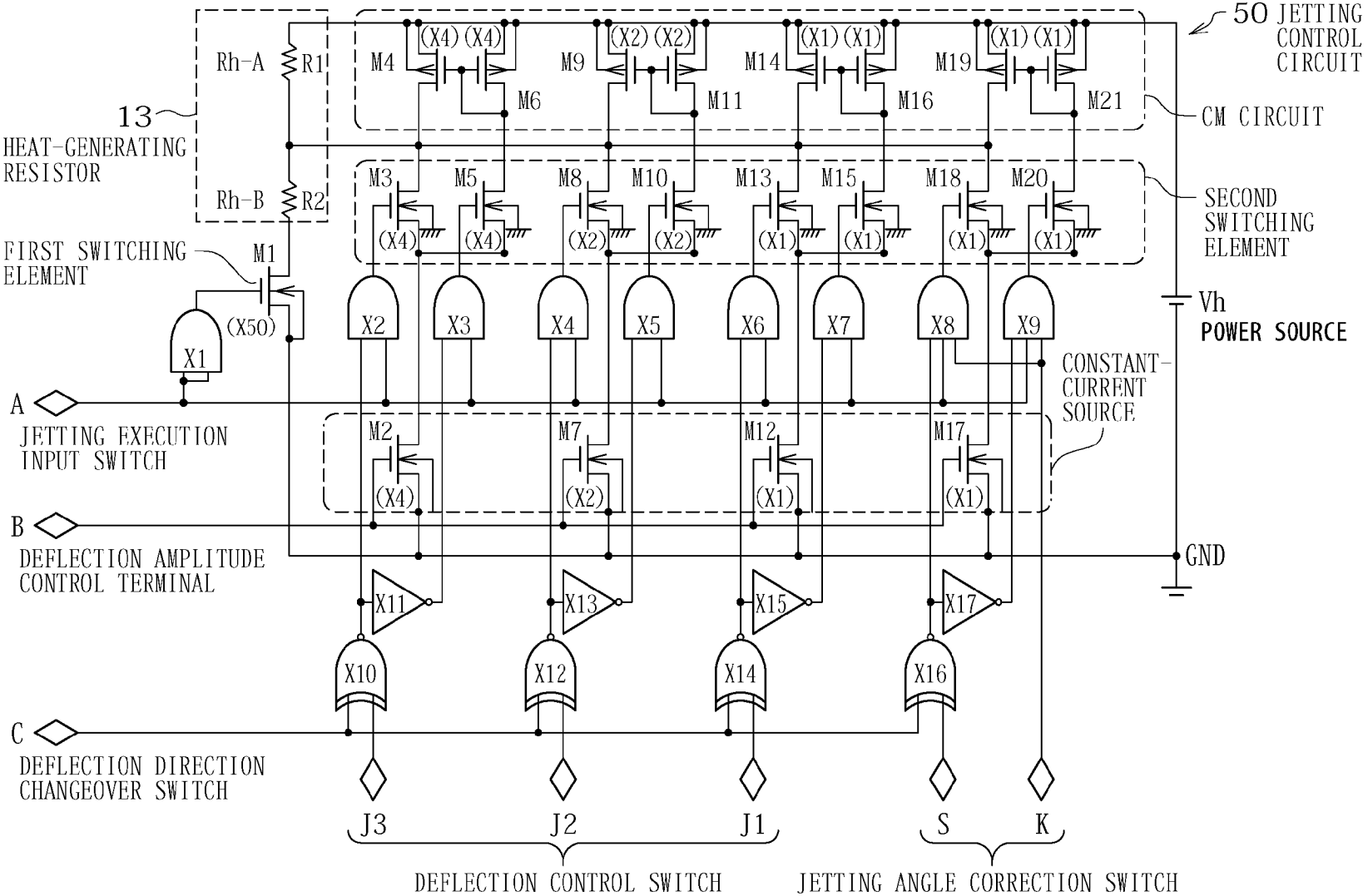
FIG. 6 illustrates one embodiment of a system for setting a bubble generation time difference for the two split heat-generating resistors.

FIG. 6 shows one embodiment of a configuration for setting a bubble generation time difference between the two split heat-generating resistors 13.

In this example, by use of a 3-bit control signal for setting the deflection direction of the droplet, the difference between the currents passed to a resistance Rh-A and a resistance Rh-B can be set in eight kinds, whereby the droplet jetting direction can be set in eight stages. In FIG. 6, the resistances Rh-A and Rh-B are the resistances of the bisected heat-generating resistors 13, and both of them are connected in series. A power source Vh is a power source for impressing a voltage on each of the resistances Rh-A and Rh-B.

A jetting control circuit 50 is a circuit for controlling the jetting direction of the droplet by controlling the difference between the currents passed to the resistance Rh-A and the resistance Rh-B, and includes transistors M1 to M21. The transistors M4, M6, M9, M11, M14, M16, M19 and M21 are PMOS transistors, and the others are NMOS transistors. The transistors M4 and M6, the transistors M9 and M11, the transistors M14 and M16, and the transistors M19 and M21 constitute current mirror circuits (hereinafter referred to as "CM circuits"), respectively. Thus, the jetting control circuit 50 includes four sets of CM circuits.

For example, in the CM circuit composed of the transistors M4 and M6, the gate and drain of the transistor M6 and the gate of the transistor M4 are connected to each other, so that an equal voltage is always impressed on the transistors M4 and M6, and substantially equal currents flow therethrough (the same applies also to the other CM circuits).

In addition, the transistors M3 and M5 function as a differential amplifier, namely, a switching element (hereinafter referred to as "second switching element") of the CM circuit composed of the transistors M4 and M6. Here, the second switching element is an element for passing a current in between the resistances Rh-A and Rh-B through the CM circuit or for causing a current to flow out from between the resistances Rh-A and Rh-B.

Further, the transistors M8 and M10, the transistors M13 and M15, and the transistors M18 and M20 are second switching elements of the CM circuits composed respectively of the transistors M9 and M11, the transistors M14 and M16, and the transistors M19 and M21.

In the CM circuit composed of the transistors M4 and M6 and the second switching element composed of the transistors M3 and M5, the drains of the transistors M4 and M3 and the drains of the transistors M6 and M5 are connected to each other (the same applies also to the other second switching elements).

Besides, the drains of the transistors M4, M9, M14 and M19 and the drains of the transistors M3, M8, M13 and M18, constituting parts of the CM circuits, are connected to the midpoint between the resistances Rh-A and Rh-B.

Further, the transistors M2, M7, M12 and M17 serves as constant-current sources for the CM circuits, respectively, and their drains are connected to the sources and back gates of the transistors M3, M8, M13 and M18, respectively.

Furthermore, the transistor M1 has its drain connected in series with the resistance Rh-B so that, when a jetting execution input switch A becomes 1 (ON), it is turned ON to pass a current to each of the resistances Rh-A and Rh-B. Namely, the transistor M1 functions as a switching element (hereinafter referred to as "first switching element") for turning ON/OFF the supply of the current to the resistances Rh-A and Rh-B.

On the other hand, output terminals of AND gates X1 to X9 are connected to the gates of the transistors M1, M3, M5, . . . , respectively. Incidentally, the AND gates X1 to X7 are of the two-input type, while the AND gates X8 and X9 are of the three-input type. At least one of the input terminals of the AND gates X1 to X9 is connected to the jetting execution input switch A.

In addition, of XNOR gates X10, X12, X14 and X16, one input terminal is connected to a deflection direction changeover switch C, while the other input terminal is connected to one of deflection control switches J1 to J3 or to a jetting angle correction switch S.

Here, the deflection direction changeover switch C is a switch for changeover for directing the jetting direction of the ink droplet to either one of two sides in the array direction of the nozzles 18. When the deflection direction changeover switch C becomes 1 (ON), one of the inputs to the XNOR gate X10 becomes 1.

In addition, the deflection control switches J1 to J3 are switches for determining the deflection amount at the time of deflecting the jetting direction of the ink droplet. For example, when the input terminal J3 becomes 1 (ON), one of the inputs to the XNOR gate X10 becomes 1.

Further, each of the output terminals of the XNOR gates X10 to X16 is connected to one of the input terminals of the AND gates X2, X4, . . . , and connected to one of the input terminals of the AND gates X3, X5, . . . through one of NOT gates X11, X13, . . . .

Besides, one of the input terminals of the AND gates X8 and X9 is connected to a jetting angle correction switch K.

Furthermore, a deflection amplitude control terminal B is a terminal for determining the current value of each of the transistors M2, M7, . . . serving as the constant-current sources for the CM circuits, and is connected respectively to the gates of the transistors M2, M7, . . . .

When an appropriate voltage (Vx) is impressed on the deflection amplitude control terminal B, Vgs (gate-source voltage) is supplied to the gates of the transistors M2, M7, . . . , so that currents flow through the transistors M2, M7, . . . , and currents flow from the transistor M3 to the transistor M2, from the transistor M8 to the transistor M7, and so on.

Besides, the source of the transistor M1 connected to the resistance Rh-B and the sources of the transistors M2, M7, . . . serving as the fixed-current sources for the CM circuits are connected to the ground (GND).

In the above configuration, the numeral in "×N (N=1, 2, 4, or 50)" parenthesized and added to each of the transistors M1 to M21 represents the parallel condition of element(s). For example, "×1" (M12 to M21) represents that a standard element is provided, and "×2" (M7 to M11) represents that an element equivalent to two standard elements connected in parallel is provided. Thus, "×N" represents that an element equivalent to N standard elements connected in parallel is provided.

Accordingly, since the transistors M2, M7, M12, and M17 are "×4", "×2", "×1", and "×1", respectively, impressing an appropriate voltage between the gate and ground of each of these transistors results in that the respective drain currents are in the ratios of 4:2:1:1.

Next, the operation of the jetting control circuit 50 will be described. First, description will be made paying attention only to the CM circuit composed of the transistors M4 and M6 and the switching element therefor composed of the transistors M3 and M5.

The jetting execution input switch A becomes 1 (ON) only at the time of jetting a droplet.

In this embodiment, when the droplet is jetted out from one nozzle 18, the jetting execution input switch A becomes 1 (ON) only for a period of 1.5 μs (1/64), and power is supplied from the power source Vh (5 V) to the resistances Rh-A and Rh-B. Conversely, for a period of 94.5 μs (63/64), the jetting execution input switch A is 0 (OFF), and this period is used for replenishing the ink into the ink chamber from which the droplet has been jetted out.

For example, when A=1, B=Vx (analog voltage), C=1, and J3=1, the output from the XNOR gate 10 is 1, and this output 1 and A=1 are inputted to the AND gate X2, so that the output from the AND gate X2 is 1. Therefore, the transistor M3 is turned ON.

Besides, when the output from the XNOR gate X10 is 1, the output from the NOT gate X11 is 0, so that this output 0 and A=1 are inputted to the AND gate X3; accordingly, the output from the AND gate X3 is 0, and the transistor M5 is turned ON.

The drains of the transistors M4 and M3 and the drains of the transistors M6 and M5 are connected to each other. Therefore, when the transistor M3 is ON and the transistor M5 is OFF as above-mentioned, a current flows from the resistance Rh-A into the transistor M3. However, no current flows in the transistor M6, since the transistor M5 is OFF.

In addition, due to the characteristics of the CM circuit, when no current flows in the transistor M6, no current flows in the transistor M4, either. Further, since the transistor M2 is ON, a current flows only from the transistor M3, among the transistors M3, M4, M5, and M6, to the transistor M2 in the above-mentioned case.

When the voltage of the power source Vh is applied under this condition, no current flows through the transistors M4 and M6, while a current flows through the resistance Rh-A.

Besides, since a current flows in the transistor M3, the current having flowed through the resistance Rh-A is branched to the side of the transistor M3 and the side of the resistance Rh-B. The current having flowed to the side of the transistor M3 flows through the transistor M2, which is determining the value of the current, before being passed to the ground. On the other hand, the current having flowed to the side of the resistance Rh-B flows through the transistor M1, which is ON, before being passed to the ground.

Therefore, the currents flowing through the resistance Rh-A and the resistance Rh-B are in the relationship i(Rh-A)>i(Rh-B).

The above description is of the case of C=1. Next, the case of C=0, i.e., the case where only the input to the deflection direction changeover switch C is different from the above (the other switches A and J3 are 1, in the same manner as above) will be described.

When C=0 and J3=1, the output from the XNOR gate X10 is 0. As a result, the inputs to the AND gate X2 are (0, 1 (A=1)), so that the output therefrom is 0. Therefore, the transistor M3 is turned OFF.

In addition, when the output from the XNOR gate X10 becomes 0, the output from the NOT gate X11 becomes 1, so that the inputs to the AND gate X3 are (1, 1 (A=1)), and the transistor M5 is turned ON.

When the transistor M5 is ON, a current flows to the transistor M6, and, due to this condition and to the characteristics of the CM circuit, a current flows also to the transistor M4.

Therefore, by the power source Vh, a current is passed through the resistance Rh-A, the transistor M4, and the transistor M6. Then, the current having flowed through the resistance Rh-A flows entirely through the resistance Rh-B (since the transistor M3 is OFF, the current flowing out of the resistance Rh-A is not branched to the side of the transistor M3). In addition, the current having flowed through the transistor M4 flows entirely into the side of the resistance Rh-B. Further, the current having flowed through the transistor M6 flows into the transistor M5.

Thus, when C=1, the current having flowed through the resistance Rh-A is branched to the side of the resistance Rh-B and the side of the transistor M3. On the other hand, when C=0, not only the current having flowed through the resistance Rh-A but also the current having flowed through the transistor M4 flows into the resistance Rh-B.

As a result, the currents flowing in the resistance Rh-A and the resistance Rh-B are in the relationship i(Rh-A)<i(Rh-B). The ratios of the two currents are symmetrical between the case of C=1 and the case of C=0.

In this manner, by setting the currents flowing into the resistance Rh-A and the resistance Rh-B to be different, it is possible to obtain a bubble generation time difference on the two split heat-generating resistors 13, and thereby to deflect the jetting direction of the ink droplet.

In addition, by selection between C=1 and C=0, the jetting direction of the droplet can be changed over to the symmetrical positions in the array direction of the nozzles 18.

While the case where only the deflection control switch J3 is turned ON/OFF has been taken as an example in the above description, when the deflection control switches J2 and J1 are further turned ON/OFF, it is possible to set the currents flowing into the resistance Rh-A and the resistance Rh-B in a finer manner.

Specifically, the currents flowing into the transistors M4 and M6 can be controlled by using the deflection control switch J3. In addition, the currents flowing into the transistors M9 and M11 can be controlled by using the deflection control switch J2, and, further, the currents flowing into the transistors M14 and M16 can be controlled by using the deflection control switch J1.

As has been described above, the drain currents can be passed in the transistors in the ratios of (transistors M4 and M6):(transistors M9 and M11):(transistors M14 and M16)= 4:2:1.

This makes it possible, by use of the three bits of the deflection control switches J1 to J3, to change the deflection direction of the droplet in the eight stages of (J1, J2, J3)=(0, 0, 0), (0, 0, 1), (0, 1, 0), (0, 1, 1), (1, 0, 0), (1, 0, 1), (1, 1, 0), and (1, 1, 1).

In addition, when the voltages impressed between the gates of the transistors M2, M7, M12 and M17 and the ground are changed, the currents can be changed, so that the deflection amount per one step can be changed while maintaining the ratios among the drain currents flowing in the transistors at 4:2:1.

In this manner, in addition to the deposition position of the droplet obtained when the droplet is jetted out from the nozzle 18 without deflection (perpendicularly to the surface of the recording medium such as a printing paper), the droplet can be jetted out with deflection to one side, and can be jetted out with deflection to the other side.

In other words, in the example illustrated in FIG. 6, the droplet can be deposited at an arbitrary one of eight positions, according to the values of inputs to the deflection control switches J1, J2 and J3. Further, by selection between C=1 and C=0, the deflection direction of the droplet can be changed over to symmetrical positions in the array direction of the nozzles 18.

While the case where the jetting direction of the droplet is deflected in eight stages by use of a control signal composed of the three bits of J1 to J3 has been taken as an example in FIG. 6, the control system is not limited to this example, and control signals of any number of bits may be used. By application of the circuit shown in FIG. 6, the jetting direction can be so deflected that the droplet will be deposited at one of M different target deposition positions.

Besides, in the example shown in FIG. 6, the two heat-generating resistors 13 have been arranged side by side as the energy generation element, and the manner of imparting energy has been controlled by setting the currents flowing in the two heat-generating resistors 13 to be different so as to provide a time difference between the periods of time taken for the ink to boil (bubble generation time) on the heat-generating resistors 13.

However, the above system is not limitative. There can also be adopted a system in which the resistances of the two heat-generating resistors 13 are equal and a difference is provided between the timings of passing the current for the heat-generating resistors 13. For example, where independent switches are provided respectively for the two heat-generating resistors 13 and the switches are turned ON at different timings, it is possible to provide a time difference between the periods of time taken for the ink to boil on the heat-generating resistors 13.

Further, there can also be adopted a combination of the setting of different current values for the heat-generating resistors 13 with the provision of the time difference between the timings of passing the current.

Incidentally, two heat-generating resistors 13 have been provided in each ink chamber 12 in the above embodiment, because it has been sufficiently verified that such a structure is endurable, and because the circuit configuration therefor can be simplified.

However, this structure is not limitative. There can also be adopted a structure in which three or more heat-generating resistors 13 are arranged side by side in each ink chamber 12. There can further be adopted a system in which no heat-generating resistor 13 is used and in which the ink (liquid) itself in the ink chamber 12 generates heat.

In addition, while the two split heat-generating resistors 13 have been used in each ink chamber in the above embodiment, the plurality of heat-generating resistors 13 may not necessarily be separated physically. Namely, heat-generating resistors 13 composed of one base member may also be used, as long as a difference can be provided in the energy distribution in the bubble generation region (surface region) thereof; for example, there may be used heat-generating resistors 13 composed of one base member in which the whole part of the bubble generation region does not generate heat uniformly and in which a difference in the generation of energy for boiling the ink can be provided between one region and other region.

Further, the manner of imparting energy may not necessarily be controlled by use of the bubble generation time difference, but may be controlled by providing a difference in energy distribution on the bubble generation region of the heat-generating resistors 13.

By use of the above-described configuration, in this embodiment, ink droplets are deposited on the recording medium such as a printing paper to form dots.

Figure 7A:
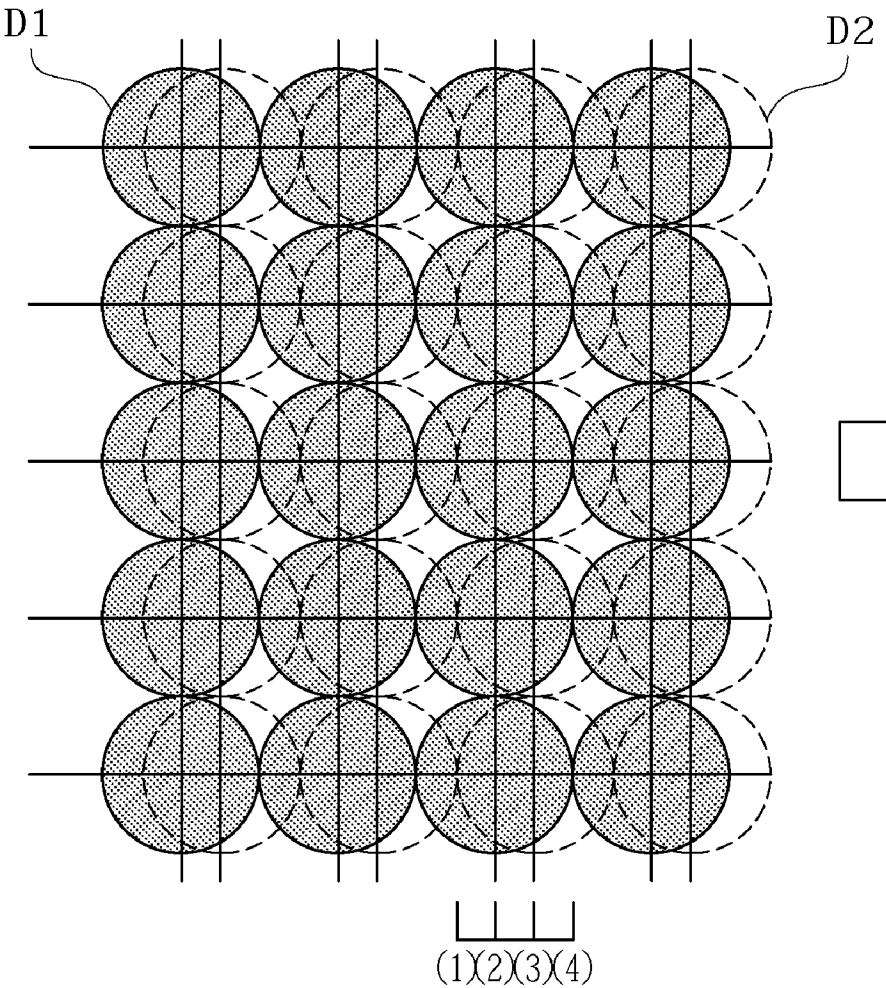
FIGS. 7A and 7B illustrate correction of errors in the deposition positions of droplets.
Figure 7B:
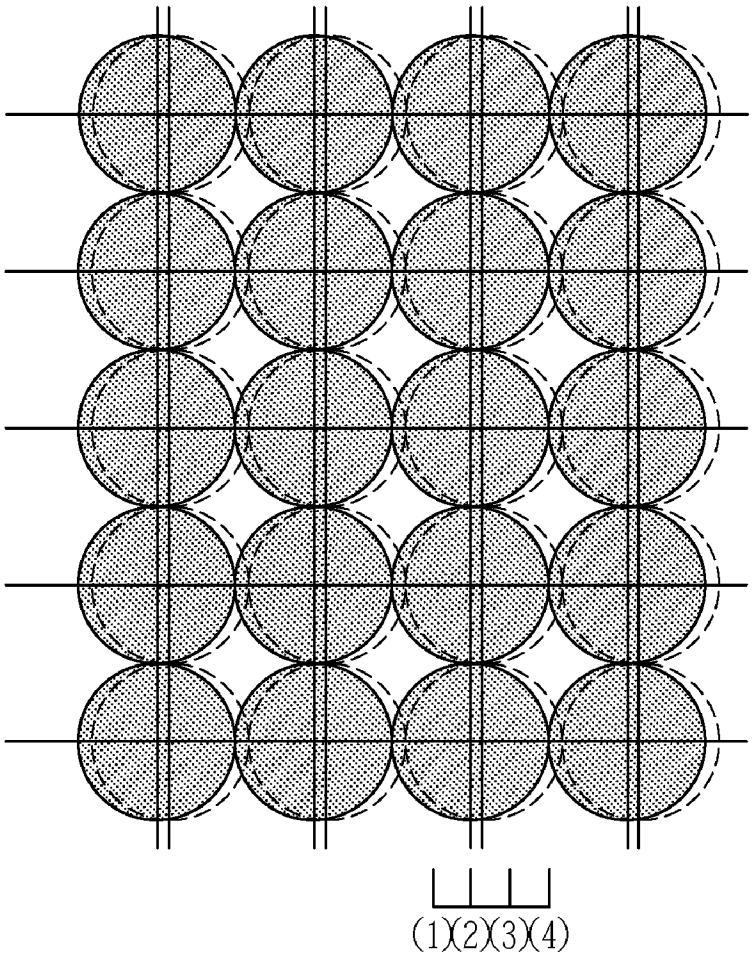
Figure 8B:
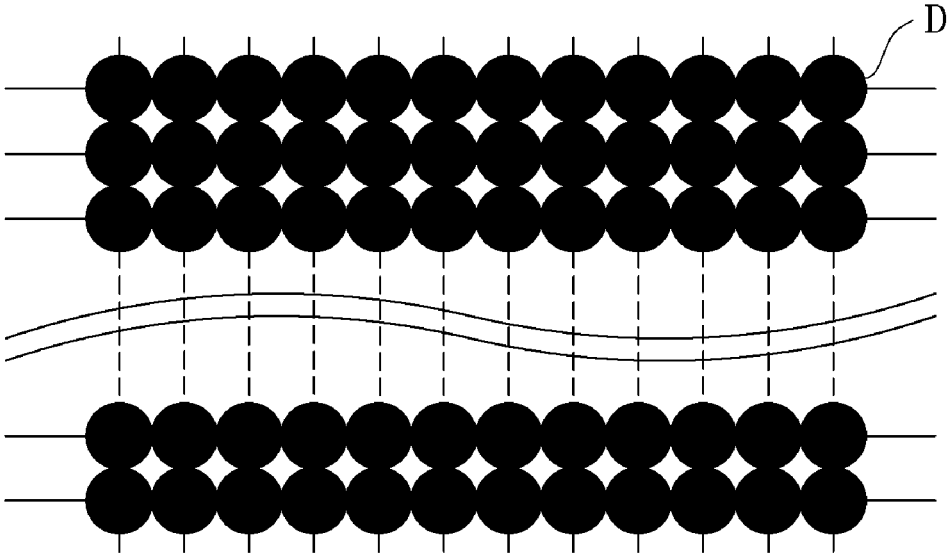

FIGS. 7A and 7B, like FIG. 8B, show the dots formed by a head array composed of four heads, for illustrating the correction of errors in the deposition positions of droplets, in which four different-colored inks are jetted out from the heads, respectively. Incidentally, the left-right direction in these figures is the array direction of the nozzles (X direction) and the up-down direction is the feeding direction of the recording medium (Y direction).

Besides, in FIGS. 7A and 7B, the deposition position of the ink droplet can be deviated in the four left-right steps (1) to (4) in the figures, the deposition position can be shifted by 25% of dot pitch by one step, and the default deposition position (no deflection) is set at (3).

Here, in FIG. 7A, the droplets jetted out from three of the four heads are forming perfectly coinciding dots D1, but the droplets jetted out from the other one head are forming dots D2 deviated in position from the dots D1.

Therefore, the dots D1 are in the color expressed by perfect superposition of three different-colored droplets, while the dots D2 are in the color of the other one colored droplet. As a result, the intrinsic color to be expressed when there is no positional error is obtained in only the overlapping areas of the dots D1 and the dots D2, and the presence of the areas of only the dot D1 and the areas of only the dot D2 lowers the print quality.

In such a case, when the three heads relevant to the accordance of the deposition positions of the droplets are kept as they are and the jetting direction of the droplets jetted out from the remaining one head is deflected to the left side, it is possible to cause the dots D2 to overlap with the dots D1, thereby alleviating the positional errors.

FIG. 7B shows the condition where the dots D2 are shifted to the left side, as compared with their positions in FIG. 7A. In this case, the deposition positions of the droplets coincide substantially, and the dots D1 and the dots D2 overlap with each other, whereby the positional errors have been greatly reduced.

Specifically, for the three heads relevant to the droplets whose deposition positions coincide under the condition of FIG. 7A, the droplets are deposited under the same condition as in the case of FIG. 7A.

On the other hand, for the head relevant to the droplets showing errors in the deposition positions, the jetting direction of the droplets is deviated so as to shift the deposition positions to the left side by 25% of dot pitch, from the deposition positions (3) to the deposition positions (2).

Such a deflection of the jetting direction can be achieved by a method in which data for correction of errors in the deposition positions of ink droplets, on the basis of each ink chamber corresponding to nozzles or on a head chip basis or on the basis of several nozzles of each head, are preliminarily stored in the printer main body or in the head chips, and the manners of imparting energy to the inks by the energy generation elements are controlled according to the stored data.

Figure 9A:
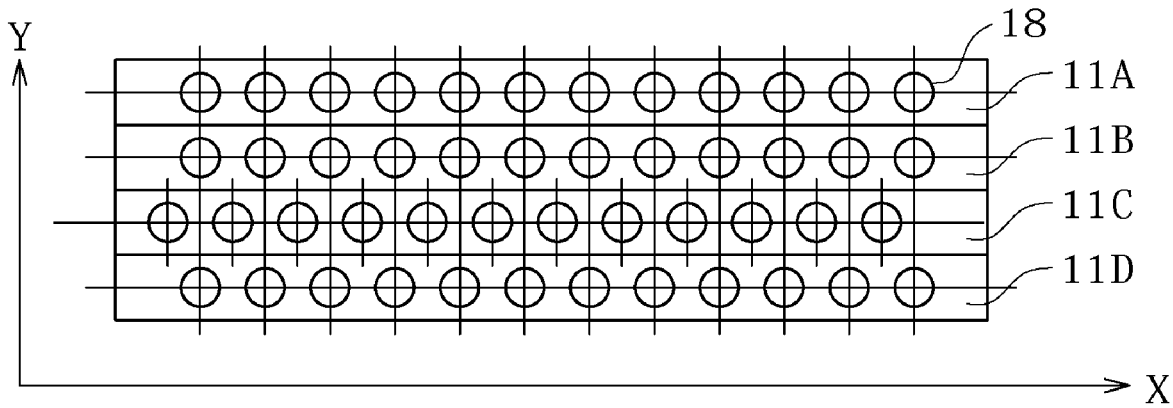
FIGS. 9A and 9B illustrate the case where one of the heads in a head array has a positional error.
Figure 9B:
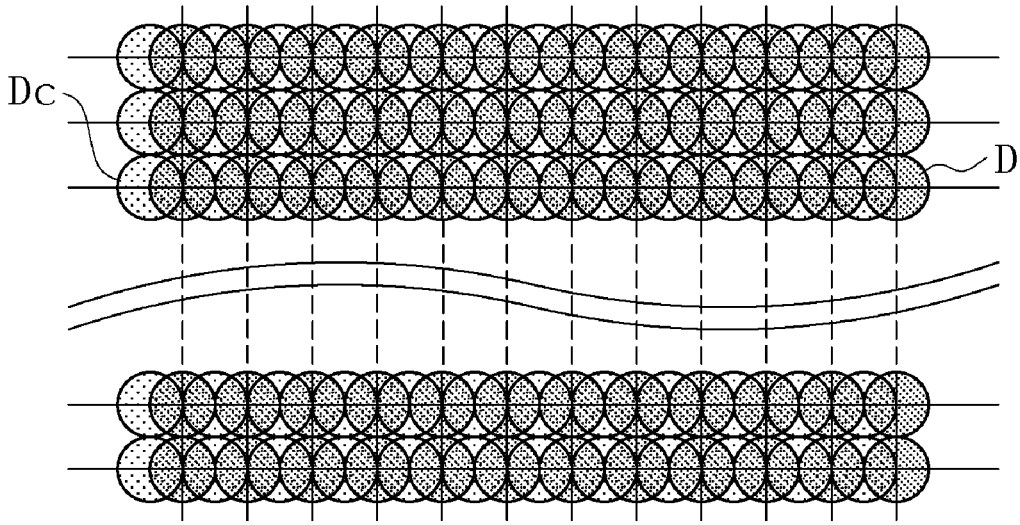

In addition, the regulation of the deposition positions of the droplets is not limited to the regulation of positional errors of formed dots but includes various kinds of regulations such as a regulation for attaining a desired overlapping of dots, and a regulation of stagger of nozzles in a head in the head array (hereinafter referred to as "misregister") as shown in FIGS. 9A and 9B.

Further, the regulation for attaining an overlapping of dots is effective not only for color printing but also for expression of gradation by an overlapping of low-concentration inks, and the like. Besides, the degree of overlapping is not limited to the perfect superposition but includes partial overlapping, a difference in an extent achieved by differences in dot size, and the like.

Next, an enhancement of the resolution of record dots will be described.

For example, in the case of the line system, the positions of the nozzles on a head basis are prefixed, and the dots cannot be interpolated by regulating the feeding amount of the recording medium. Therefore, if the jetting direction of the droplets jetted out from the nozzles is not deflected, the deposition positions of the droplets onto the recording medium are prefixed. Therefore, where the resolution is 600 DPI, for example, the nozzle pitch is determined to be 42.3 μm.

On the other hand, in the case of the serial system, the resolution can be changed comparatively easily, by moving the head by a predetermined amount in the nozzle array direction of the head (sub-scanning direction) after one pass of printing in the main scanning direction (printing one time in the main scanning direction), and thereafter printing again. For example, printing in a resolution of 1200 DPI can be achieved by a method in which a one-pass amount of printing is conducted by a head designed for realizing 600 DPI (nozzle pitch: 42.3 μm), then the head is moved in the sub-scanning direction by an amount of (2N+1)/2 times the pitch of 42.3 μm (N is an integer), and a one-pass amount of printing is similarly conducted again in this condition in such a manner that dots are formed at midpoints between the previously printed dots.

Such a technique cannot be applied to the line system which is not intended to print by moving the head in the width direction of the recording medium.

Figure 10A:
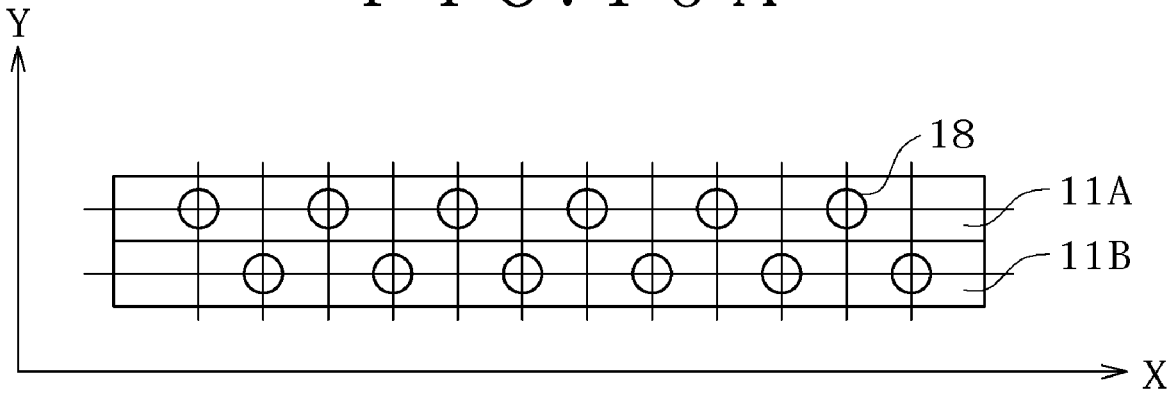
FIGS. 10A and 10B illustrate an increase in resolution achieved by a staggered arrangement of nozzles.
Figure 11A:
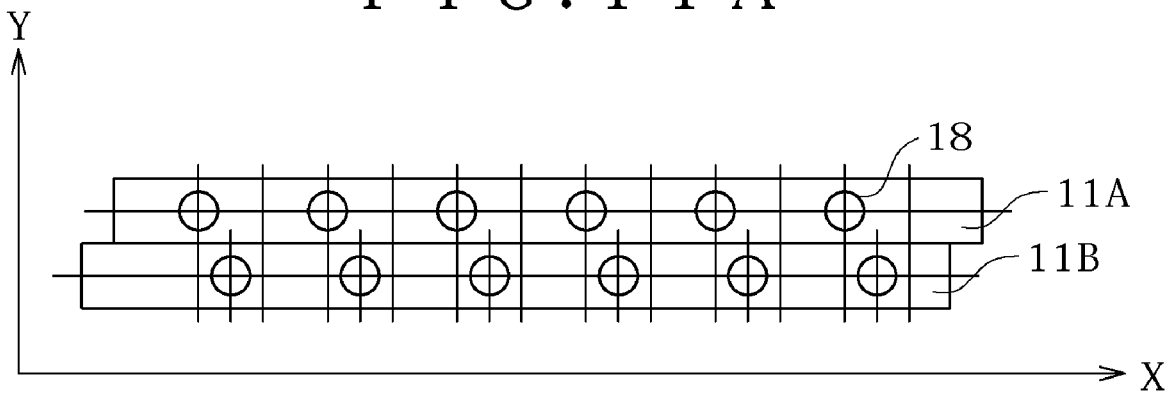
FIGS. 11A and 11B illustrate the case where heads arranged in a staggered manner have a positional error.

In view of this, it may be contemplated to contrive a higher resolution than the resolution based on the nozzles in individual heads, by arranging the heads in a staggered manner as shown in FIG. 10A. However, in some cases, a misregister as shown in FIG. 11A may occur, making it impossible to obtain an accurate staggered layout.

Figure 10B:
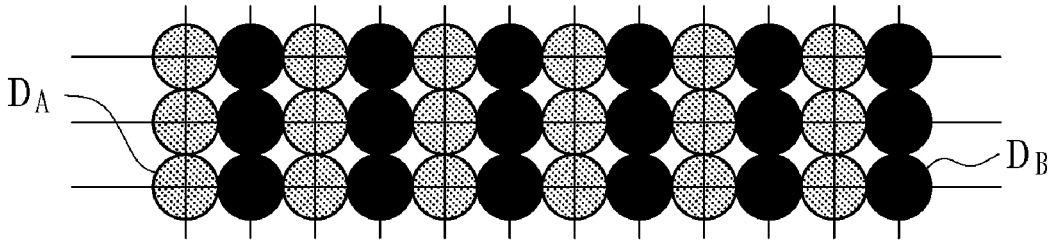
Figure 11B:
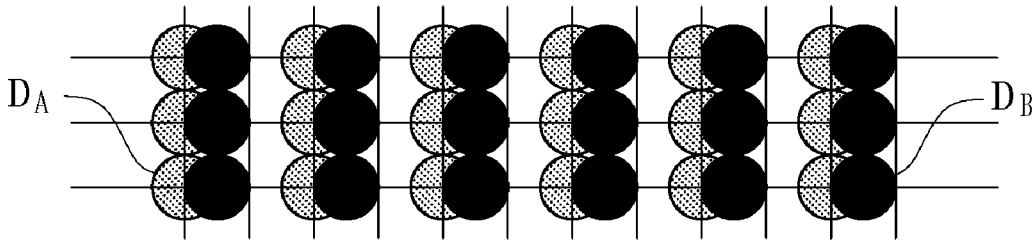

In this case, however, it suffices to deflect the jetting direction of the droplets jetted out from the heads and to regulate the deposition position of the droplets so that the groups of dots formed on the basis of the individual heads in the head array do not overlap with each other. Namely, the errors in the deposition positions are corrected to bring the dots closer to the normal staggered positions, thereby preventing the print quality from being lowered. Specifically, where a positional error is present between the heads 11A and 11B in the head array as shown in FIG. 11A, the dots $D_A$ and $D_B$ are not arranged at the same pitch, as shown in FIG. 11B. In such a case, by deflecting the jetting direction of the droplets jetted out from one or both of the heads 11A and 11B, it is possible to arrange the dots $D_A$ and $D_B$ at an equal pitch, as shown in FIG. 10B.

Here, according to the staggered arrangement in two rows, the resolution based on the nozzles can be doubled. Further, by use of a staggered arrangement in three or more rows, it is possible to contrive a further enhancement of resolution. In this case, where nozzles are arrayed at a pitch P and S pieces of heads are arranged in the head array, all the heads in the head array can be effectively used for enhancement of resolution, by regulating the deposition positions of droplets so that the centers of the dots are staggered by P/S, respectively.

Besides, in the case of color printing, for example, when two or more heads per color are arranged in a staggered layout and it is ensured that dots relevant thereto do not overlap with each other, it is possible to obtain a higher resolution in color printing.

Incidentally, the above-described regulation can naturally be applied not only to the line system but also to the serial system.

Furthermore, as has been described above, for attaining a higher resolution, it may be contemplated to arrange the dots according to D.I. (Dot-Interleave; a technique in which the pitch of dots in each pass is fixed and the dots formed in the next pass are interposed at midpoints between the dots formed in the preceding pass).

Then, the deposition positions of the droplets in the adjacent passes are alternately deviated from each other by 50% of dot pitch, whereby the effective resolution can be enhanced. When such a dot arrangement is not attained due to a misregister or the like, it suffices to deflect the jetting direction or directions and to regulate the deposition positions of the droplets.

Thus, by using the misregister compensating means according to this embodiment in combination with the resolution enhancing means based on D.I., it is possible to enhance the print quality.

In addition, the misregister compensating means according to this embodiment can be applied to a technique similar to the dither technique.

Specifically, when a 2-bit value is outputted by a pseudo random function generator and the output value is added to a deflection signal for the jetting direction of droplets, the deposition positions of the droplets are shifted in an appropriate manner. When a misregister is present, the intrinsic effect of this technique can be obtained by using this technique in combination with the misregister compensating means according to the present embodiment.

Further, the misregister compensating means according to the present embodiment can be applied to a resolution enhancing means independent of the staggered arrangement.

For example, in the case of printing by use of heads designed for realizing a resolution of 600 DPI (nozzle pitch: 42.3 μm), the resolution is enhanced when the jetting direction or directions of droplets are deflected to achieve interpolation of dots. The interpolation makes it possible to print at a resolution equal to twice, four times, eight times, etc. of the original resolution attained without interpolation.

Such enhancement of resolution is particularly effective in the cases where the dot size is smaller than the nozzle pitch. When an error is generated in the interpolation positions due to a misregister, the print quality can be enhanced by using the misregister compensating means according to the present embodiment in combination with the above-mentioned resolution enhancing means.

While the system in which the heat-generating resistors 13 are provided as a thermal-type jetting structure has been taken as an example in the present embodiment, the energy generation element is not limited to the heat-generating resistor, but may be other heat-generating element (other than resistance). Further, those of the electrostatic jetting system and those of the piezo system are also applicable.

Here, an energy generation element (corresponding to the heat-generating resistors 13) of the electrostatic jetting system includes a vibrating sheet, and two electrodes provided on the lower side of the vibrating sheet, with an air layer interposed therebetween. A voltage is impressed between the electrodes, thereby deflecting the vibrating sheet to the lower side, and thereafter the voltage is reduced to 0 V, thereby releasing the electrostatic force. In this case, the elastic force at the time of the return of the vibrating sheet into its original state is utilized to jet out an ink droplet.

In this case, for providing a difference between the generations of energy at the energy generation elements, for example, a time difference may be provided between the two energy generation elements at the time when the vibrating sheet is returned into its original state (when the voltage is reduced to 0 V to thereby release the electrostatic force), or the voltages impressed on two energy generation elements may be set at different values.

On the other hand, the energy generation element of the piezo system includes a laminate of a piezo element, which is provided with electrodes on both sides thereof, with a vibrating sheet. When a voltage is impressed between the electrodes on both sides of the piezo element, a bending moment is generated in the vibrating sheet by the piezoelectric effect, whereby the vibrating sheet is deflected and deformed. This deformation is utilized to jet out an ink droplet.

In this case, like in the above case, for providing a difference between the generations of energy at the energy generation elements, a time difference may be provided between two piezo elements at the time when the voltage is impressed on the electrodes on both side of the piezo element, or the voltages impressed on two piezo elements may be set at different values.

Furthermore, in the present embodiment, the jetting direction of droplets can be deflected in the array direction of the nozzles 18. This is because the two heat-generating resistors 13 are arranged side by side in the array direction of the nozzles.

However, the array direction of the nozzles (the X direction) and the droplet deflection direction may not necessarily coincide exactly with each other; even where the directions are slightly deviated from each other, substantially the same effect as in the case of exact coincidence of the nozzle array direction with the droplet deflection direction can be expected. Therefore, such a degree of deviation between the two directions does not matter.

Incidentally, while errors in the deposition positions in the Y direction arising from a positional error of the nozzles in the Y direction can be coped with by correction of the jetting timing, use of this technique in combination with the present embodiment makes it possible to achieve compensation for general positional errors. Namely, it is possible by similar means to achieve appropriate regulations for coping with compound deviations composed of positional errors in the X direction, positional errors in the Y direction, angular errors of the nozzle array, etc.

Such regulations can be applied to not only the line system but also the serial system.

The present invention is applicable not only to printers but also to a variety of other liquid jetting devices. Examples include devices for jetting a dye toward a material to be dyed, and devices for jetting a DNA-containing solution for detection of an organism specimen.

According to the present invention, nozzles are arrayed to constitute a head, a plurality of the heads are arrayed in a direction orthogonal to the array direction of the nozzles to constitute a head array, the jetting direction of droplets jetted out from the nozzles can be deflected by controlling the manner of imparting energy to a liquid by energy generation elements, and errors in the deposition positions of dots arising from a positional error of the head are corrected. Therefore, the present invention is suitable for use in the case of color printing, for achieving an expression of a smooth gradation, for enhancement of resolution, and the like purposes, and makes it possible to prevent the print quality from being lowered in such cases.

The present invention is not limited to the details of the above-described preferred embodiment. The scope of the invention is defined by the appended claims and all changes and modifications as fall within the equivalence of the scope of the claims are therefore to be embraced by the invention.

What is claimed is:

1. A liquid jetting device comprising:

a liquid chamber for containing a liquid to be jetted out;

an energy generation element for imparting energy to said liquid in said liquid chamber; and a nozzle for jetting out said liquid in said liquid chamber as a droplet by said energy generation element, wherein a plurality of said nozzles being arrayed to constitute a head, and a plurality of said heads being arrayed in a direction orthogonal to the array direction of said nozzles to constitute a head array, said droplet jetted out from each of said nozzles in said head array being deposited on a recording medium to form a dot, the jetting direction of said droplet jetted out from said nozzle can be deflected by controlling the manner in which the energy is imparted to said liquid by said energy generation element, an error in the deposition position of said dot due to an error in the position of said head in said head array is corrected, and said nozzles are arrayed at a pitch P and said head array comprises S heads, errors in the deposition positions of the dots are corrected so that a center of the dot formed by the droplet jetted out from the n-th nozzle of one head in said head array and the center of the dot formed by the droplet jetted out from the n-th nozzle of another head in said head array are staggered from each other by P/S.

2. A liquid jetting device as set forth in claim 1, wherein the array direction of said head array is set to a feeding direction of said recording medium, and an error in the deposition position of said dot in the direction orthogonal to said feeding direction is corrected.

3. A liquid jetting method comprising the steps of:

imparting energy to a liquid in a liquid chamber by an energy generation element, jetting out said liquid in said liquid chamber as droplets from nozzles arrayed in a head, and depositing said droplets jetted out from the nozzles on a recording medium to form dots, wherein the jetting direction of said droplet jetted out from the nozzle can be deflected by controlling the manner in which the energy is imparted to said liquid by said energy generation element, an error in the deposition position of said dot due to an error in the position of said head in a head array formed by arraying said heads in a direction orthogonal to the array direction of said nozzles is corrected, and said nozzles are arrayed at a pitch P and said head array comprises S heads, errors in the deposition positions of the dots are corrected so that a center of the dot formed by the droplet jetted out from the n-th nozzle of one head in said head array and the center of the dot formed by the droplet jetted out from the n-th nozzle of another head in said head array are staggered from each other by P/S.

* * * * *